US007568852B2

(12) United States Patent
Nottelman et al.

(10) Patent No.: US 7,568,852 B2
(45) Date of Patent: Aug. 4, 2009

(54) PRINTER WITH RECIPROCATING PRINTHEAD CARRIAGE

(75) Inventors: Frank J. H. Nottelman, Belfeld (NL); Barry B. Goeree, Venlo (NL); Henk-Jan Zwiers, Venlo (NL); Bas W. J. J. A. Van Dorp, Eindhoven (NL); Luc G. T. Dircks, Leunen (NL)

(73) Assignee: OCE' -Technologies B.V., Venlo (NL)

( * ) Notice: Subject to any disclaimer, the term of this patent is extended or adjusted under 35 U.S.C. 154(b) by 566 days.

(21) Appl. No.: 11/312,525

(22) Filed: Dec. 21, 2005

(65) Prior Publication Data

US 2006/0120789 A1 Jun. 8, 2006

(30) Foreign Application Priority Data

Dec. 22, 2004 (EP) ..... 04106831

(51) Int. Cl.
*B41J 19/18* (2006.01)
*B41J 29/02* (2006.01)

(52) U.S. Cl. ..... 400/705.1; 400/719

(58) Field of Classification Search ..... 400/705, 400/705.1, 705.4, 705.5
See application file for complete search history.

(56) References Cited

U.S. PATENT DOCUMENTS

| | | | | |
|---|---|---|---|---|
| 6,010,206 | A | 1/2000 | Simons | |
| 6,264,303 | B1 | 7/2001 | Watanabe | |
| 6,450,714 | B2 * | 9/2002 | Mori et al. | 400/649 |

FOREIGN PATENT DOCUMENTS

| | | | |
|---|---|---|---|
| EP | 0 810 546 | A2 | 3/1997 |
| EP | 1 077 139 | A2 | 2/2001 |
| EP | 1 393 921 | A2 | 3/2004 |
| JP | 03173667 | A * | 7/1991 |
| JP | 10-253318 | | 9/1998 |
| JP | 2000289281 | A * | 10/2000 |

* cited by examiner

*Primary Examiner*—Daniel J Colilla
(74) *Attorney, Agent, or Firm*—Birch, Stewart, Kolasch & Birch LLP

(57) ABSTRACT

A printer including: a frame, a bearing assembly mounted to said frame, a platen rotatably supported in the bearing assembly for advancing a sheet of a recording medium, a guide rail mounted to the frame and extending in parallel with an axial direction (Y) of the platen, a ruler extending in parallel with the guide rail, a carriage driven to reciprocate along the guide rail and carrying a printhead, and a detector arranged to detect the position of the carriage relative to the ruler, wherein, in said axial direction (Y), the ruler is rigidly fixed at a location of the bearing assembly independently of the guide rail.

7 Claims, 2 Drawing Sheets

PRINTER WITH RECIPROCATING PRINTHEAD CARRIAGE

This non-provisional application claims priority under 35 U.S.C. § 119(a) on Patent Application No. 04106831.3 filed in Europe on Dec. 22, 2004, which is herein incorporated by reference.

BACKGROUND OF THE INVENTION

The present invention relates to a printer comprising: a frame, a bearing assembly mounted to the frame, a platen rotatably supported in the bearing assembly for advancing a sheet of a recording medium, a guide rail mounted to the frame and extending in parallel with the axial direction of the platen, a ruler extending in parallel with the guide rail, a carriage driven to reciprocate along the guide rail, said carriage carrying a printhead, and a detector arranged to detect the position of the carriage relative to the ruler.

A typical example of a printer of this type is an ink jet printer having a printhead or printheads adapted to expel droplets of liquid ink onto the recording medium that is advanced over the platen. The timings at which the nozzles of the printhead are energized must be accurately synchronized with the movement of the carriage. To this end, the carriage is equipped with a detector for reading markings on the ruler. In order to achieve a high print quality, it is a prerequisite that the position of the ruler relative to the recording medium in the direction of the reciprocating movement of the carriage is stable over the whole print process.

In a conventional printer, the ruler is fixed at the guide rail, and the frame has a very stiff construction so that it will not be distorted by forces of inertia that are created by the acceleration and deceleration of the carriage.

SUMMARY OF THE INVENTION

The present invention provides a printer which has a simple construction and nevertheless permits a high print quality, especially in high-speed printing. According to the present invention, a printer is provided wherein, in the axial direction, the ruler is rigidly fixed at a location of the bearing assembly independent of the guide rail.

Thus, the position of the ruler is directly coupled to the position of the bearing assembly which itself defines the axial position of the platen and hence the position of the sheet of the recording medium. When the frame becomes distorted, this will induce a lateral displacement of both the platen and the guide rail, but the displacement of the guide rail will be different from that of the platen. However, since the ruler is not coupled to the guide rail but to the bearing assembly for the platen, the lateral displacement of the ruler will be the same as that of the platen, so that a stable relation between the position of the ruler and the recording medium is assured. As a result, the stiffness requirements for the frame may be less strict, which leads to a cost and weight reduction. Also the print quality is improved or, for a given print quality, the carriage may be accelerated and decelerated more rapidly, so that a higher throughput can be achieved.

The bearing assembly typically is formed by two bearings that are fixed at respective frame members at opposite ends of the platen. In one embodiment, both ends of the ruler are rigidly held at a respective one of the two bearings. In another embodiment, only one end of the ruler is held at one of the bearings, and the other end of the ruler is elastically connected to the frame, so that the ruler is tensioned between the two frame members. Then, the elastic suspension of the ruler permits the ruler to follow the lateral displacements of the one bearing to which it is connected.

The rigid connection between the end of the ruler and the bearing may preferably be achieved by means of a holding plate that is oriented in parallel with the axial direction of the platen, so that it has a high stiffness in this axial direction. The holding plate may be mounted to a bracket that is itself attached to the bearing or to a frame member directly at the mounting position of the bearing.

If the platen and the ruler are arranged on opposite sides of the guide rail, the mounting plate may form an extended arm which passes through a slot formed in the guide rail.

BRIEF DESCRIPTION OF THE DRAWINGS

Preferred embodiments of the invention will now be described in conjunction with the drawings, in which.

DETAILED DESCRIPTION OF THE INVENTION

Figure 1:
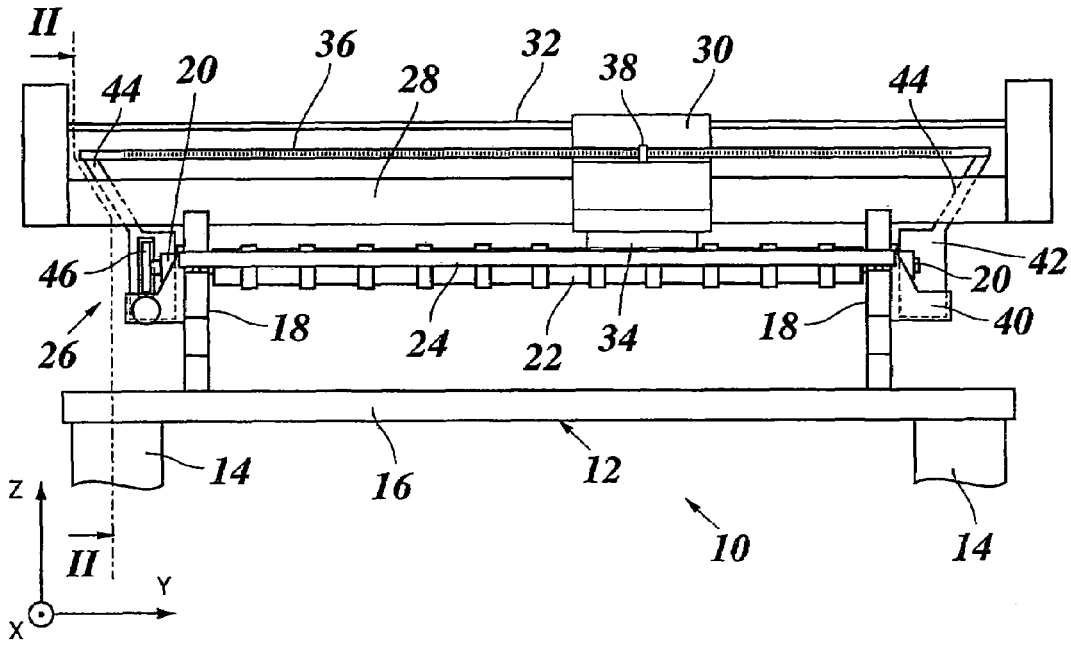
FIG. 1 is a front view of a printer according to the present invention.

The printer shown in FIG. 1 comprises a frame 10 which is composed of a lower frame 12 formed by two uprights 14 and two cross-bars 16, and an upper frame that is formed by two plate-like frame members 18 projecting upwardly from the cross-bars 16.

A bearing assembly is formed by two bearings 20 which rotatably support a platen 22 between the two frame members 18.

A sheet support plate 24 is horizontally supported on the two frame members 18 and serves to support a sheet of a recording medium (not shown in FIG. 1) which is advanced in X-direction (normal to the plane of the drawing in FIG. 1) by means of the platen 22. A worm-type drive mechanism 26 for the platen 22 is arranged near one of the bearings 20 (on the left side in FIG. 1).

A guide rail 28 rests on the top ends of the frame members 18 and extends in parallel with the axial direction Y of the platen 22. A carriage 30 is guided on the guide rail 28 and is driven to move back and forth along the guide rail by means of a belt drive mechanism 32. The carriage 30 has a portion extending over the sheet support plate 24, and a printhead 34 is mounted on the bottom side of this carriage portion so as to face the sheet that is advanced over the sheet support plate 24. The printhead 34 may, for example, be a hot melt ink jet printhead.

A ruler 36 extends above and in parallel with the guide rail 28 and has markings that can be read by a detector 38 mounted on the carriage 30. On the basis of the markings read by the detector 38, an electronic control system of the printer determines the timings at which the print units or nozzles of the printhead 34 are energized while the carriage 30 moves across the recording medium.

As can best be seen on the right side in FIG. 1, a bracket 40 is rigidly mounted on each of the bearings 20, more precisely, on the stationary part of the bearing, and a holding plate 42 oriented in the Y-Z-plane is rigidly secured to the bracket 40. Each holding plate 42 forms an arm 44 which extends obliquely upwardly and outwardly through a slot formed in the guide rail 28. The ruler 36 is, with its opposite ends, rigidly held between the top ends of the arms 44.

On the left side in FIG. 1, the bracket 40 also accommodates the drive mechanism 26, and the holding plate 42 straddles a worm gear 46 of the drive mechanism.

Figure 2:
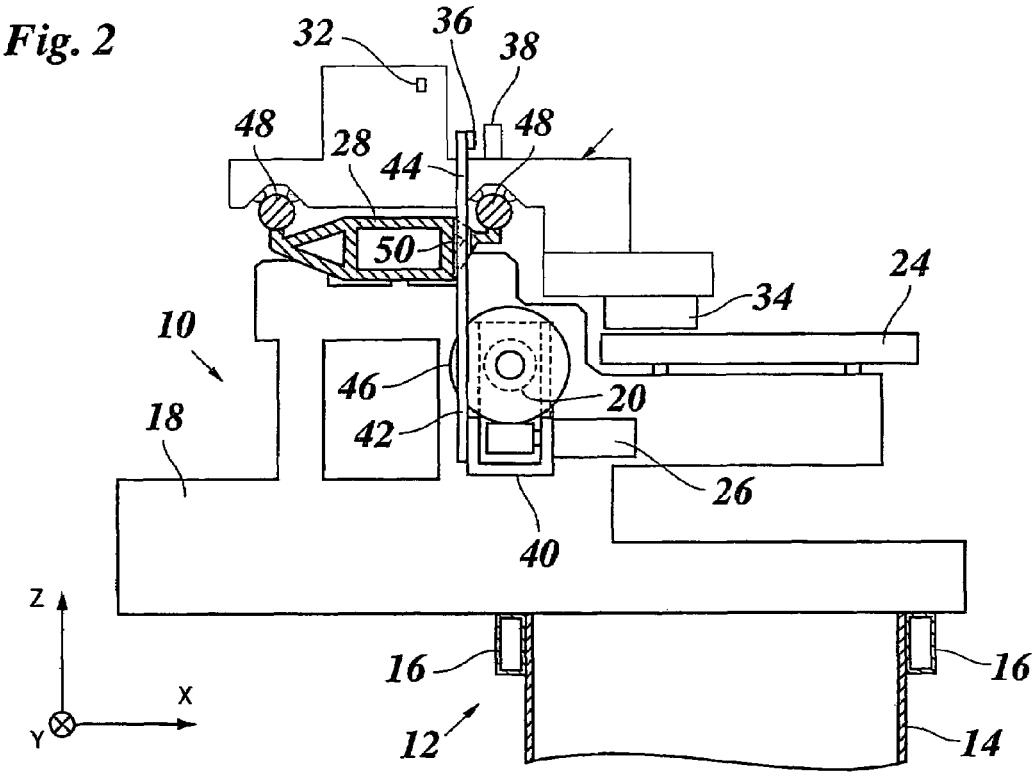
FIG. 2 is an enlarged cross-section taken along the line II-II of FIG. 1.

As is shown in FIG. 2, the guide rail 28 is formed by a profile member which supports two cylindrical rods 48 on which the carriage 30 is supported and guided with roller bearings. The slot for the arm 44 is indicated as 50. The inclined position of the arms 44, as shown in FIG. 1, has the advantage that the ruler 36 can be held under a certain tension and at the same time permits the carriage 30 to travel over the full width of the sheet support plate.

The main advantage of the mounting structure for the ruler 36 as described above will now be explained in conjunction with FIGS. 3 and 4 which, however, show a slightly modified embodiment.

Figure 3:
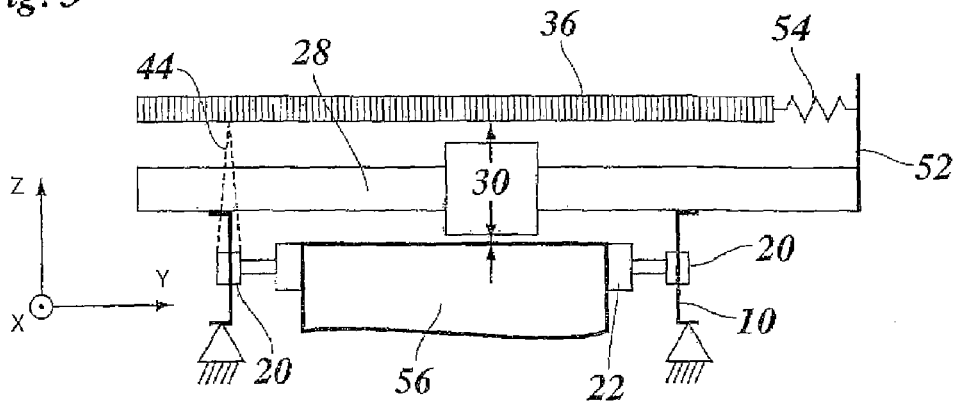
FIG. 3 is a schematic front view of a printer according to a modified embodiment.
Figure 4:
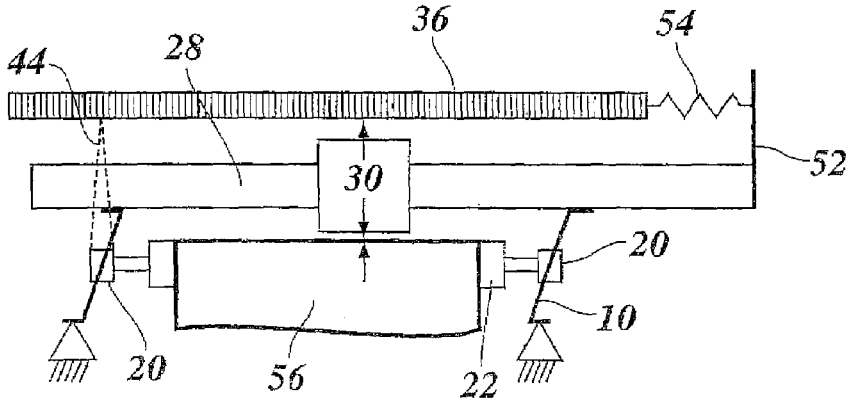
FIG. 4 is a schematic front view analogous to FIG. 3, illustrating a distorted condition of a frame.

As is symbolically shown in FIG. 3, only one end (left) of the ruler 36 is directly connected to one of the bearings 20 by means of the arm 44, whereas the other end of the ruler is elastically connected to a frame member 52 which projects from the guide rail 28. The elastic suspension of that end of the ruler 36 is symbolised by a spring 54.

The spring 54 will hold the ruler 36 under a certain tension, but nevertheless, as in the first embodiment, the position of the ruler in Y-direction will be determined by the position of the bearing 20 and will thus be locked to the Y-position of the platen 22 and the sheet 56 advanced thereby.

When the carriage 30 moves back and forth along the guide rail 28, the drive mechanism for the carriage (not shown in FIG. 3) and the guide rail 28 will be subject to considerable forces of inertia, especially when large format prints, such as A0, are made with a high throughput, so that the acceleration and deceleration rates of the carriage are high. These forces tend to distort the frame 10, as has exaggeratedly been shown in FIG. 4. As a result of this distortion, the guide rail 28 is offset in Y-direction relative to the sheet 56 on the platen 22. However, since the ruler 36 is rigidly held by the arm 44, the markings on the ruler 36 will exactly be kept in registry with the sheet 56 on the platen 52. As a result, the distortion of the frame 10 will have no influence on the print position on the sheet 56, as is indicated by arrows in FIGS. 3 and 4. The relative movement between the ruler 36 and the guide rail 28 is absorbed by the spring 54 in this embodiment.

Figure 5:
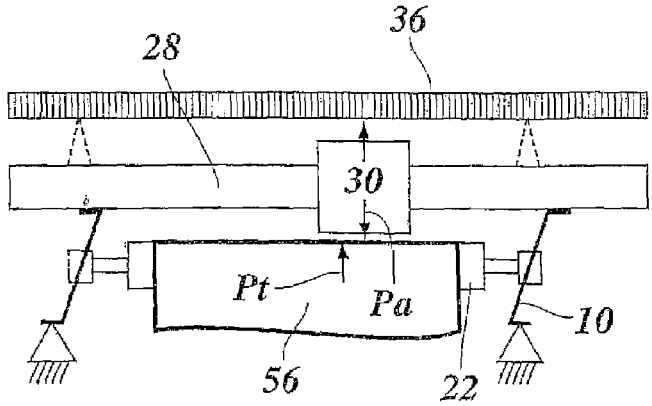
Fig. 5 CONVENTIONAL ART
FIG. 5 is a schematic view analogous to FIG. 4, for a printer according to a comparison example.

For comparison, FIG. 5 illustrates the conventional case where the ruler 36 is rigidly supported at the guide rail 28. Then, the distortion of the frame 10 leads to a displacement of the ruler markings and hence of the actual print position Pa in Y-direction relative to the intended target print position Pt, and the print quality is adversely affected. The present invention successfully solves this problem.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printer comprising:

a frame, a bearing assembly mounted to said frame, a platen rotatably supported in the bearing assembly for advancing a sheet of a recording medium, a guide rail mounted to the frame and extending in parallel with the axial direction (Y) of the platen, a ruler extending in parallel with the guide rail, a carriage driven to reciprocate along the guide rail, said carriage carrying a printhead, and a detector arranged to detect the position of the carriage relative to the ruler, wherein in said axial direction (Y), the ruler is rigidly fixed at a location of the bearing assembly, independently of the guide rail.

2. The printer according to claim 1, wherein the bearing assembly comprises two bearings, one at each end of the platen, and both ends of the ruler are rigidly connected to respective bearings.

3. The printer according to claim 1, wherein one portion of the ruler is rigidly connected to a single bearing of the platen, and at least one other portion of the ruler is elastically connected to a part of the frame or the guide rail.

4. The printer according to claim 1, further comprising a holding plate oriented in a plane (Y-Z) in parallel with the axial direction (Y) of the platen and connecting an end portion of the ruler to the bearing for the platen.

5. The printer according to claim 4, wherein the holding plate forms an arm which extends obliquely outwardly from the bearing to the end portion of the ruler.

6. The printer according to claim 5, wherein the ruler and the platen are arranged on opposite sides of the guide rail and the holding plate forms an arm which passes through a slot formed in the guide rail.

7. The printer according to claim 6, wherein the holding plate is fixed to a bracket that is fixed on the bearing and/or at a frame part directly at the mounting position of the bearing.

* * * * *